US005209563A

United States Patent [19]

Swisher, Jr. et al.

[11] Patent Number: 5,209,563

[45] Date of Patent: May 11, 1993

[54] DUST RETURN SYSTEM

[75] Inventors: George W. Swisher, Jr., Oklahoma City; Stuart W. Murray, Edmond, both of Okla.

[73] Assignee: CMI Corporation, Oklahoma City, Okla.

[21] Appl. No.: 416,374

[22] Filed: Oct. 2, 1989

[51] Int. Cl.[5] ..... B28C 5/46; B01F 15/02

[52] U.S. Cl. ..... 366/22; 222/145; 366/34; 366/35; 366/149; 366/151; 366/178; 366/182

[58] Field of Search ..... 366/20, 22, 24, 28, 366/23, 25, 34, 35, 37, 38, 40, 7, 6, 8, 2, 149, 151, 156, 177, 181, 182, 178; 432/111; 34/135, 136, 137, 33; 222/135, 145

[56] References Cited

U.S. PATENT DOCUMENTS

| | | | |
|---|---|---|---|
| 765,975 | 7/1904 | Hooley | 366/23 X |
| 775,414 | 11/1904 | Berrigan | 366/156 X |
| 1,531,594 | 3/1925 | Carozza et al. | 366/6 |
| 1,546,335 | 7/1925 | Browne | 366/35 X |
| 2,901,988 | 9/1959 | Hepburn | 366/156 X |
| 4,103,350 | 7/1987 | Brock et al. | 366/22 |
| 4,184,771 | 1/1980 | Day | 366/182 X |
| 4,211,490 | 7/1989 | Brock et al. | 366/11 |
| 4,475,818 | 10/1984 | Bialkowski | 366/20 X |
| 4,688,945 | 8/1987 | Brazelton et al. | 366/156 |
| 4,801,210 | 1/1989 | Gian | 366/156 |
| 4,838,701 | 6/1989 | Smith et al. | 366/136 |

OTHER PUBLICATIONS

Brochure "Dri-Flo The Only All Purpose Pneumatic Pump", 4 pages, Jul. 1, 1987.

*Primary Examiner*—Harvey C. Hornsby
*Assistant Examiner*—Charles Cooley
*Attorney, Agent, or Firm*—Dunlap, Codding & Lee

[57] ABSTRACT

A closed, pressurized dust return system for introducing aggregate dust into a stream of liquid asphalt is provided. Aggregate dust is dispensed through a valve from a receiving chamber into a mixing housing. The aggregate dust enters the mixing housing at an intermediate location therein. The liquid asphalt is introduced into the mixing housing through a separate conduit at a location thereon above the point of entry of the aggregate dust. The liquid asphalt and the aggregate combine within the mixing housing to form a slurry composition. A heating jacket substantially surrounds the mixing housing and a system for preventing liquid asphalt from backing up into the receiving chamber is also provided. The dust return system is particularly useful in an asphalt plant using a baghouse.

14 Claims, 5 Drawing Sheets

DUST RETURN SYSTEM

BRIEF SUMMARY OF THE INVENTION

1. Field of the Invention

The present invention is directed to a system for mixing aggregate dust with liquid asphalt.

2. Background of the Invention

In the present state of the art of introducing particulate additives, such as reclaimed aggregate dust or mineral filler, into asphalt drum mixers, the additives are exposed to a spray of liquid asphalt in the drum mixer in an attempt to coat the additives. The coated additives readily combine with the mixing asphaltic materials and generally do not become airborne within the drum mixer.

However, in many instances, a portion of the additives introduced into the drum mixer via the above method escape coating by the liquid asphalt spray. The uncoated additives that do not combine with the mixing aggregate materials within the drum are carried out of the drum in the exhaust gas stream and re-collected by the emission system. Consequently, the work load on the emission system is increased.

The present invention eliminates these disadvantages by providing a closed, pressurized system for thoroughly coating the additives with liquid asphalt. The additives are injected into a stream of liquid asphalt and become suspended therein producing a slurry. In this state, the additives adhere to the mixing asphaltic materials within the drum; thus reducing emissions and providing greater control of the product composition.

BRIEF DESCRIPTION OF THE INVENTION

FIG. 6 is an elevational view of a dust pump with portions removed illustrating some internal structures.

DETAILED DESCRIPTION OF THE DRAWINGS

Figure 1:
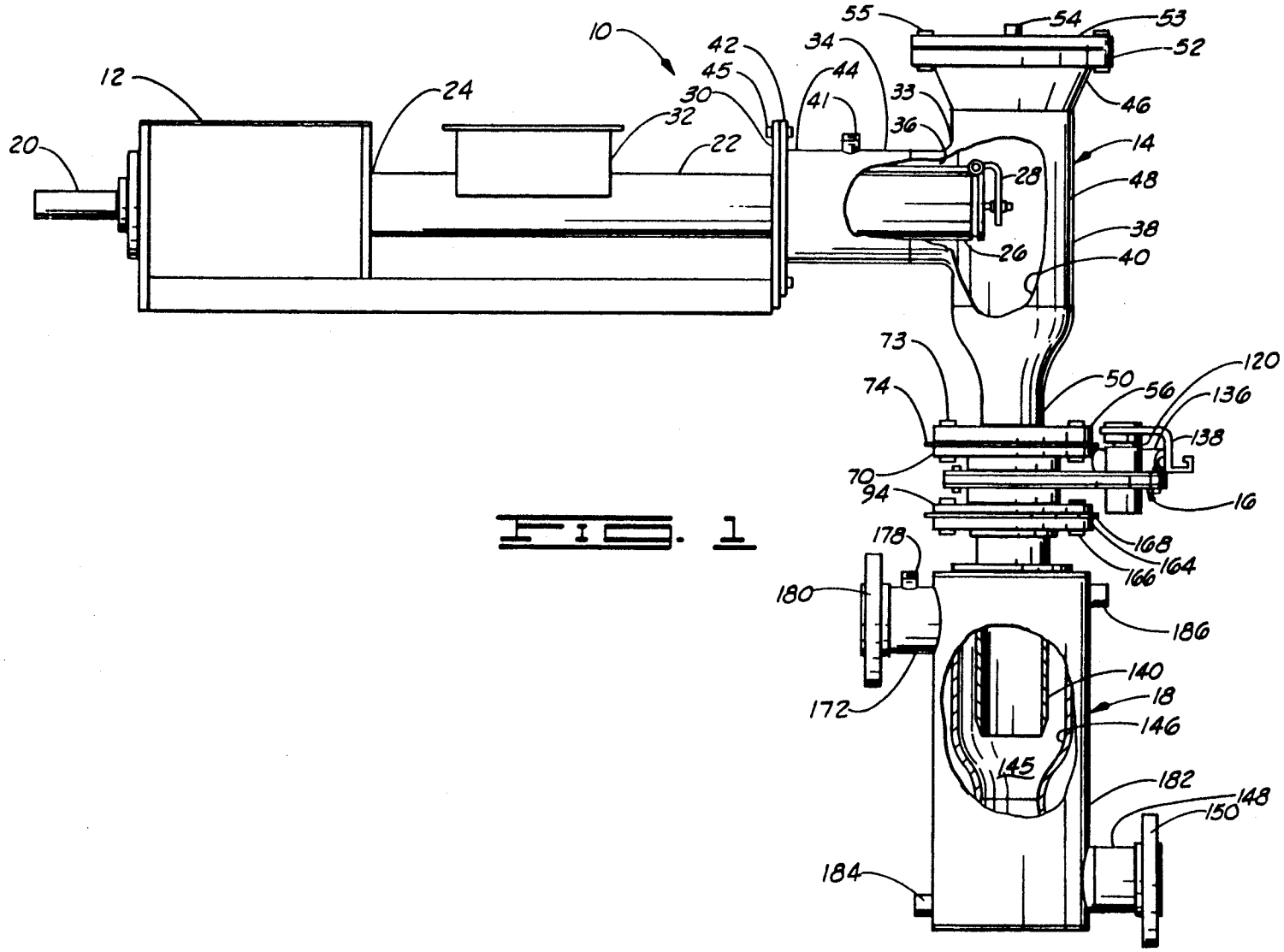
FIG. 1 is an elevational view of a dust return system constructed in accordance with the present invention with portions removed to illustrate some internal structure.

As shown in FIG. 1, the present invention comprises a dust return system designated generally by the reference numeral 10. The dust return system 10 generally comprises a dust pump 12, preferably model number 410, manufactured by Dry-Flo, Inc., Denver, Colo.; a receiving housing 14; a valve 16 and mixing chamber 18.

The dust pump 12 is provided with an external drive assembly connected to shaft 20 for powering an auger 21 (FIG. 6) described in greater detail below. The auger 21 extends into a cylinder 22 which is secured at a first end 24 to the drive assembly 20. A second end 26 of the cylinder 22 is provided with a one way valve 28 which extends into the receiving housing 14. A flange 30 is secured to the exterior of the cylinder 22 between the first end 24 and the second end 26 for a purpose to be discussed below. In operation, particulate materials enter the cylinder 22 through an inlet structure 32 (as from a bag house) and are urged by the rotation of the auger 21 towards the second end 26 and into the receiving housing 14.

The housing 14 is formed by the intersection of a first end 33 of a horizontal duct 34 with a vertical duct 38. A cavity 36 in the horizontal duct 34 communicates with a cavity 40 in the vertical duct 38 at the intersection of the horizontal duct 34 and the vertical duct 38. A pressurized gas inlet fitting 41 extends from the horizontal duct 34 for a purpose to be discussed below.

The portion of the conduit 22 between the second end 26 and the flange 30 extends through horizontal duct 34 and into the cavity 40 of the vertical duct 38. A flange 42, secured to a second end 44 of the horizontal duct 36, is attached to the flange 30 of the conduit 22 by a plurality of bolts 45. In this way, the dust pump 12 is secured to the receiving housing 14.

The cavity 40 of the vertical duct 38 is defined by an expanded first end 46, a cylindrical body 48 and a reduced second end 50. A flange 52 is provided at the upper portion of the first end 46. A plate 53, having a fitting 54 for a purpose to be discussed below, and sized for overlying the flange 52, is removably secured thereto by a plurality of bolts 55. A flange 56 is provided at the lower portion of the second end 50 for securing the receiving housing 14 to the valve 16.

Figure 2:
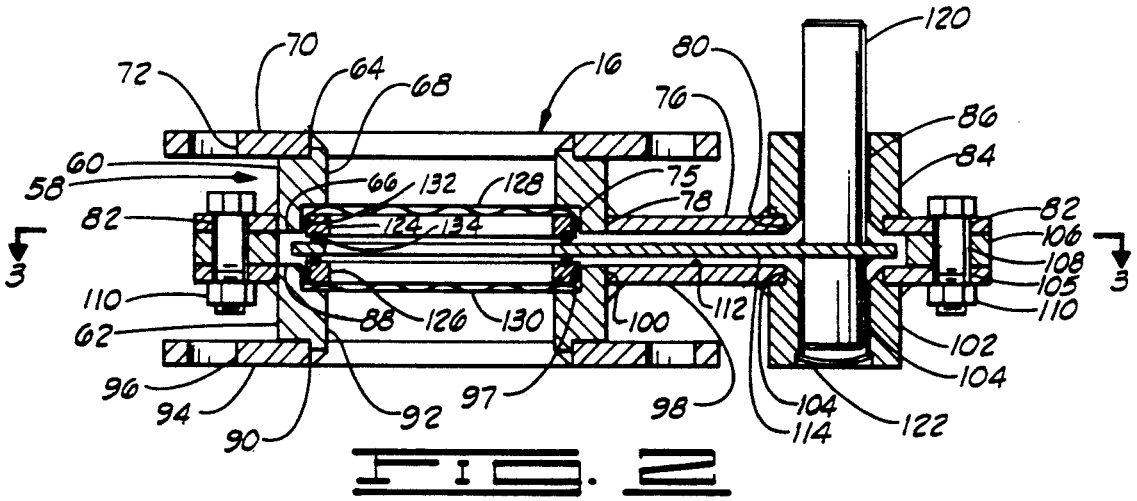
FIG. 2 is an enlarged vertical cross-sectional view of the valve portion of the dust return system.
Figure 3:
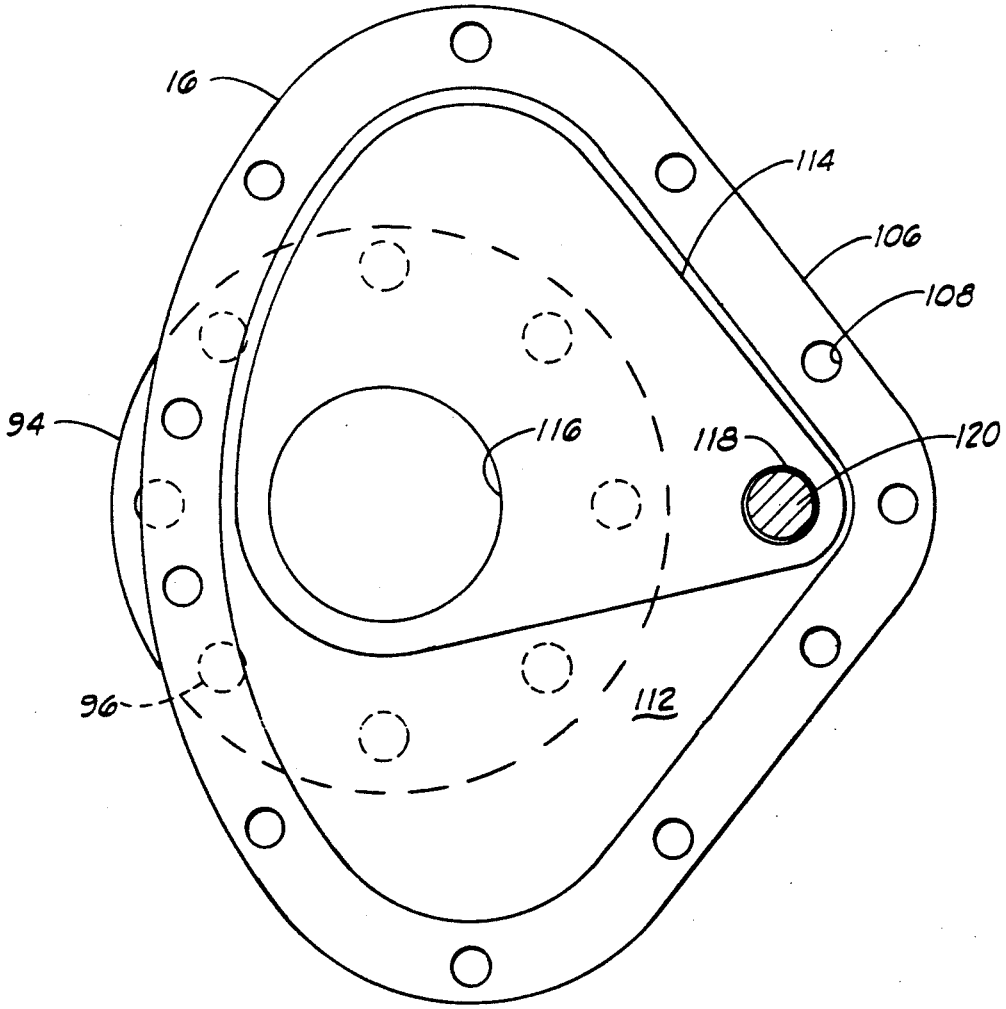
FIG. 3 is a cross-sectional view taken along lines 3—3 in FIG. 2.

As most clearly shown in FIGS. 2 and 3, the valve 16 includes a valve body 58 having separable upper and lower body portions 60 and 62. The upper body portion 60 has an upstream end 64, a downstream end 66 and a bore 68 extending therethrough.

At the upstream end 64, a flange 70, having a plurality of peripheral apertures 72, is secured thereto. Bolts 73 (FIG. 1), extending through the apertures 72 of the flange 70 and apertures (not shown) in the flange 56, secure the valve 16 to the housing 14. A gasket 74 may be positioned between the flanges 56 and 70 to ensure the seal between the valve 16 and the housing 14. At the downstream end 68, an annular groove 75 encircles the interior surface thereof for a purpose described in detail below.

A pear-shaped plate 76, having a first aperture 78, a second aperture 80 and a plurality of apertures 82 peripherally oriented thereon, is secured, as by welding, to the downstream end 66 of upper body portion 60 such that the bore 68 communicates with the first aperture 78. A sleeve 84, having a bore 86 extending therethrough, is secured, as by welding, to the plate 76 such that the bore 86 is vertically aligned with the second aperture 80.

The lower body portion 62 is provided with an upstream end 88, a downstream end 90 and a bore 92 extending therethrough. At the down stream end 90, a flange 94, having a plurality of peripheral apertures 96, is secured thereto. At the upstream end 88 an annular groove 97 encircles the interior surface thereof for a purpose described in detail below.

A plate 98, similar in construction to the plate 76, is secured, as by welding, to the upstream end 88 of the lower body portion 62 such that the bore 92 communicates with a first aperture 100 in the plate 98. A sleeve 102, having a bore 103 extending therethrough, is secured, as by welding, to the plate 98 such that the bore 103 is in vertical alignment with a second aperture 104 in the plate 98. The plate 98 is also provided with a plurality of apertures 105 peripherally oriented thereon.

A spacer ring 106, having a plurality of apertures 108 therein, is positioned between the plates 76 and 98 such that the apertures 82, 108 and 105 are vertically aligned. Bolts 110, extending through apertures 82, 108 and 105, snugly secure the spacer ring 106 between the plates 76 and 98. Securing the plates 76 and 98, as descrived above, vertically aligns the bore 68 of the upper body portion 60 with the bore 92 of the lower body portion 62 and the bore 86 of the sleeve 84 is aligned with the bore 103 of sleeve 102.

The positioning of the spacer ring 106 as described above forms a cavity 112 defined by the plates 76 and 98 and the inner vertical wall of the spacer ring 106. A pear-shaped valve disk 114, having a first aperture 116 and a second aperture 118 (FIG. 3) is captured within the cavity 112. A shaft 120, sized for rotational movement within sleeves 84 and 102, extends through the bore 86 of the sleeve 84 and the second aperture 118 of the valve disk 114 and terminates within the bore 103 of the sleeve 102. The valve disk 114 is secured, as by welding, to portions of the shaft 120 adjacent the second aperture 118 such that the valve disk 114 is spaced equally between the plates 76 and 98. A plug 122 is secured to the lower end of the sleeve 102.

A pair of sealing rings, 124 and 126, each sized for insertion into the annular grooves 75 and 97, respectively, are urged by wave springs 128 and 130, against the valve disk 114. Each of the sealing rings, 124 and 126, is provided with a pair of O-rings 132 and 134. The O-ring 132 is positioned between the sealing ring and the adjacent annular groove and the O-ring 134 is positioned between the sealing ring and the valve disk 114.

The valve 16 is actuated by a ram 136 (FIG. 1). The ram 136 is connected to the shaft 120 by an lever arm 138. Movement of the lever arm 138 by the ram 136 rotates the shaft 120 such that the valve disk 114 is pivoted within the cavity 112 between an open position (FIG. 3) and a closed position (not shown). In the open position, the first aperture 116 of the valve disk 114 vertically aligns with bores 68 and 92. In this way, particulate material collected within the receiving housing 14 is dispensed into the mixing chamber 18. In the closed position, portions of the valve disk 114 form an occlusion between the bores 68 and 92 such that particulate material from the receiving housing 14 is prevented from entering the mixing chamber 18.

Figure 4:
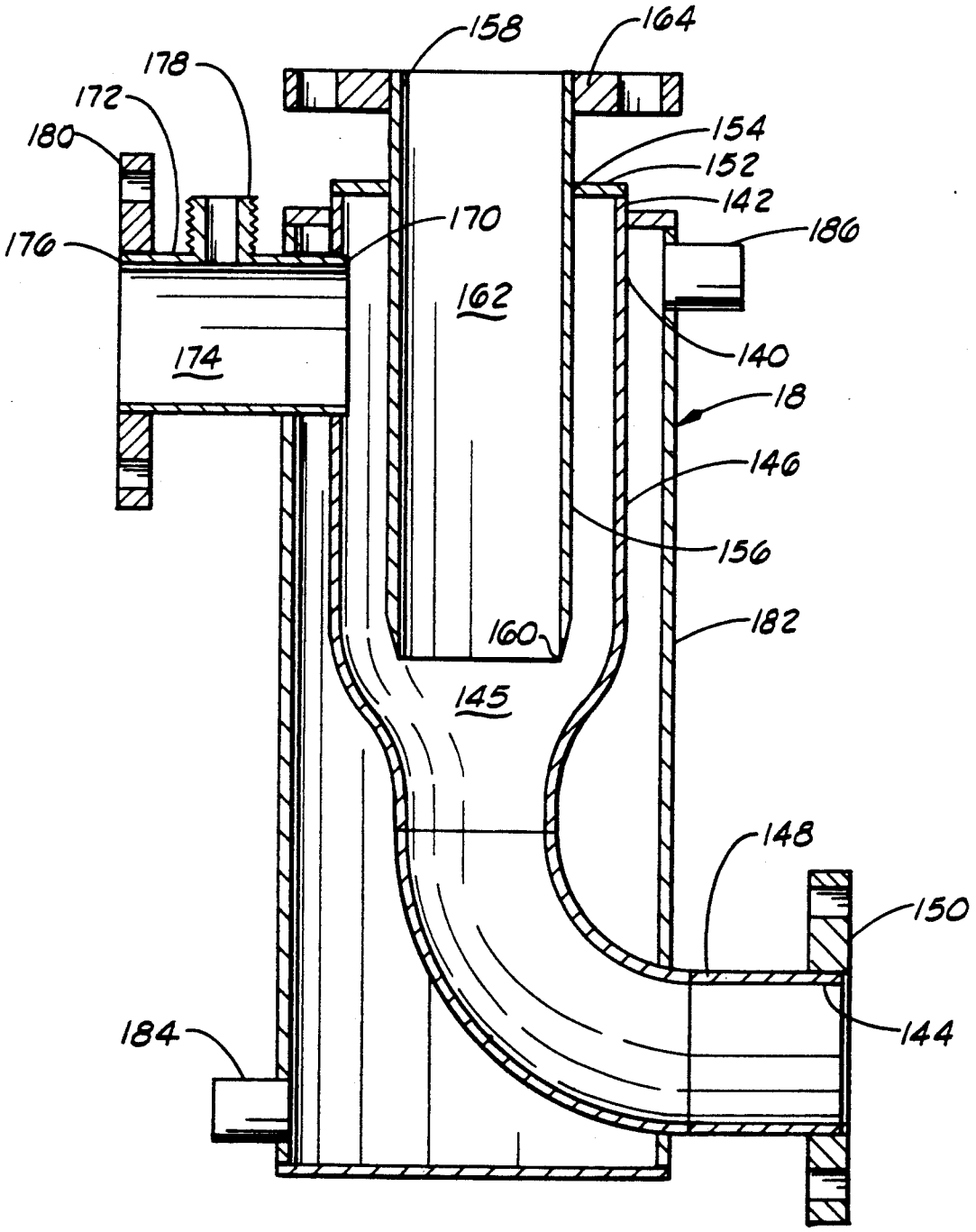
FIG. 4 is an enlarged vertical cross-sectional view of the lower portion of the system illustrated in FIG. 1.

As shown in FIG. 4, the mixing chamber 18 is provided with a cylinder 140 having a first end 142, a second end 144 and an opening 145 intersecting the first and second ends, 142 and 144. The cylinder 140 is provided with an expanded portion 146 extending from the first end 142 and terminating at an intermediate location along the length thereof. A smaller diameter portion 148 extends from the second end 144 at a right angle and terminates at the an intermediate location along the length of the cylinder 140 adjacent the expanded portion 146. A flange 150 is secured to the second end 144 of the cylinder 140.

A ring 152, having an aperture 154, overlies and is secured to the first end 142 of the cylinder 140 such that the opening 154 concentricly aligns with the opening 145 at the first end 142. A duct 156, having a first end 158, a second end 160 and an opening 162 intersecting the first and second ends, 158 and 160, extends through the aperture 154 and is centered within the opening 145. The duct 156 is secured to the ring 152 such that the first end 158 is above the ring 152 and the second end 160 is substantially adjacent the transition between the expanded portion 146 and the reduced portion 148 of the cylinder 140.

A flange 164, secured to the first end 158 of the duct 156, is secured to the flange 94 (FIG. 1) by a plurality of bolts 166. A gasket 168 may be positioned between the flanges 94 and 164 to ensure the seal between the valve 16 and the mixing housing 18.

With continued reference to FIG. 4, a first end 170 of a conduit 172 extends through an aperture in the expanded portion 146 of the cylinder 140. An opening 174 within the conduit 172 communicates with the opening 145 at a location therein substantially adjacent the first end 142 of the cylinder 140. The opening 174 traverses the length of the conduit 172 and connects the first end 170 with a second end 176 thereof. An apertured fitting 178 extends from the conduit 172 at an intermediate location thereon for a purpose to be discussed below. Additionally, a flange 180 is provided at the second end 176 of the conduit 172.

A heating jacket 182 substantially surrounds the cylinder 140 and is provided with a inlet fitting 184 and an outlet fitting 186. The upper and lower ends of the jacket 182 are closed. A heated liquid, preferable oil, is circulated through the jacket 182 to assist in maintaining the flow of the liquid asphalt through the mixing housing 18.

Figure 5:
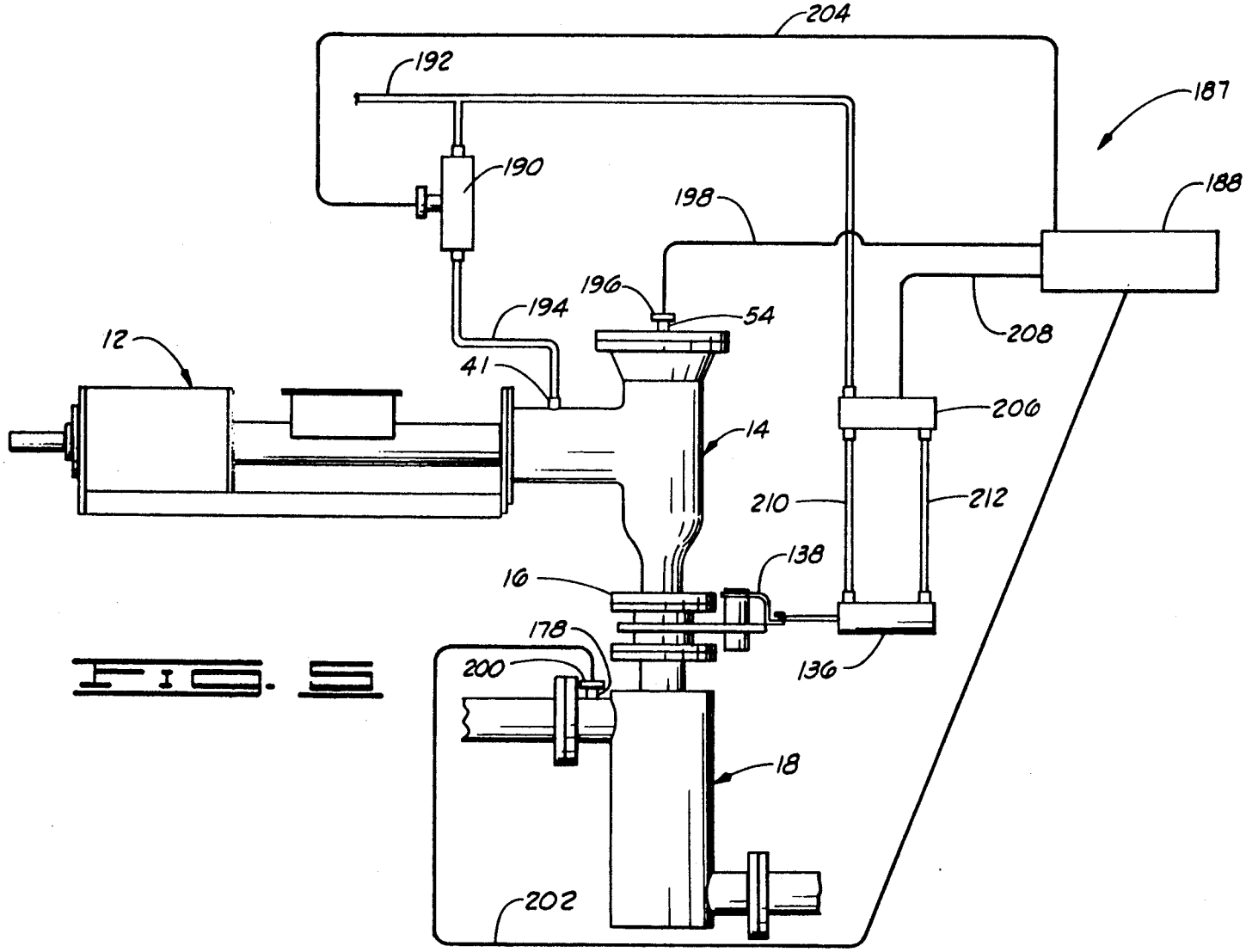
FIG. 5 is a semi-schematic illustration of a pressure monitoring system.
Figure 5:
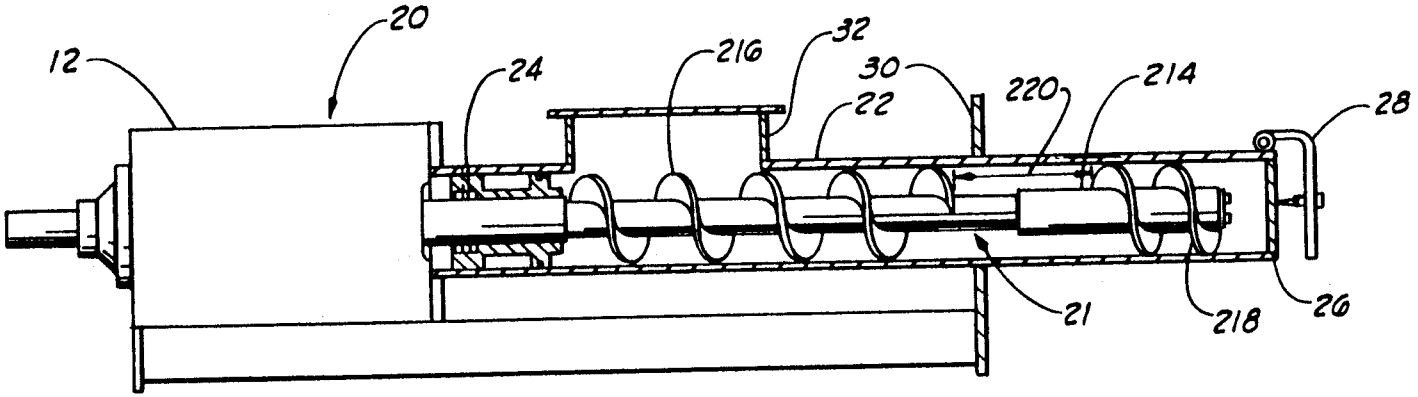

As shown in FIG. 5, a pressure monitoring system 187, utilizing a computer 188, controls the flow of particulate material through the valve 16. An automatic pressure regulator 190, responsive to the computer 188 and supplied by a gas pressure line 192, pressurizes the receiving chamber 14 via line 194 and inlet 41.

A pressure sensor 196, secured to the fitting 54, generates a computer input signal which is transmitted to the computer 188 by the electrical conduit 198. This computer input signal corresponds to the pressure within the receiving chamber 14. A pressure sensor 200, secured to the fitting 178, generates another computer input signal which is transmitted to the computer 188 by the electrical conduit 202. This computer input signal corresponds to the pressure of the liquid asphalt within the mixing housing 18.

The computer 188 compares the signal from the pressure sensor 200 with the signal from the pressure sensor 196. If the signal from the pressure sensor 200 does not exceed a preselected value, the computer 188 generates a first and second computer output signal. The first computer output signal is transmitted to the regulator 190 through an electrical conduit 204. The second computer output signal is transmitted to a solenoid 206 through an electrical conduit 208.

The regulator 190 responds to the first computer output signal by maintaining the pressure in the receiving chamber 14 at a selected differential above the pressure of the liquid asphalt in the mixing housing 18. In this way, liquid asphalt is prevented from entering the receiving chamber 14. The solenoid valve 206 responds to the second output signal by pressurizing the ram 136 via a pressure line 210 such that the valve 16 opens.

If the signal from the pressure sensor 200 exceeds the preselected value, the solenoid 206, responsive to a third computer output signal generated by the computer 188 and transmitted by the electrical conduit 208, reverses the flow of pressurized gas into the ram 136 via lines 210 and 212 causing the valve 16 to close. The regulator 190, responsive to the fourth computer output signal, closes, preventing further pressure buildup in the receiving housing 14.

It will be understood that the preselected value and the selected differential may vary according to the nature and construction of the materials and components used in building the system. In the use of the present invention, for returning dust from a bag house to a drum mixer, the selected differential may be 0.2 PSI and the preselected value may be equivalent to 30 PSI gauge.

As shown in FIG. 6, the auger 21 includes a rotatable shaft 214 and pair of discontinuous helical blades, 216 and 218. Helical blade 216 extends along the shaft 214 from the inlet structure 32 to an intermediate point on the shaft 214. Helical blade 218 extends along the shaft 214 from the second end 26 of the cylinder 22 and terminates a distance 220 from the helical blade 216.

Particulate material entering the inlet structure 32 is urged within the cylinder 22 toward the valve 28 by the rotation of the helical blade 216. As sufficient quantities of particulate material enter the area between the helical blades 216 and 218, a slug of particulate material (not shown) is formed. As additional quantities of particulate material enter the cylinder 22 from the bag house, the material slug lengthens filling the area within the cylinder 22 defined by the distance 220. The slug of particulate material creates a gas lock within the cylinder 22 between the bag house and the receiving housing 14. The gas lock prevents a turbulent flow of carrier gas, such as compressed air, from entering the receiving housing 14. By substantially eliminating the turbulent flow of carrier gas into the receiving housing 14, the dust particles and the liquid asphalt may be more evenly combined within the mixing chamber 18.

Portions of the material slug contacting the rotating helical blade 218 are removed therefrom and conveyed through the valve 28 into the receiving housing 14. Once inside the receiving housing, the particulate material transits the valve 16 and combines with a stream of liquid asphalt within the mixing chamber 18 such that a slurry stream of particulate material and liquid asphalt is formed.

As a result of the gas lock created in the cylinder 22 and the stream of liquid asphalt through the mixing chamber 18, along with the pressure monitoring system 187, the receiving housing 14, the valve 16 and the mixing chamber 18 in concert form a closed, pressurized environment in which the slurry of particulate material and liquid asphalt is formed.

Figure 7:
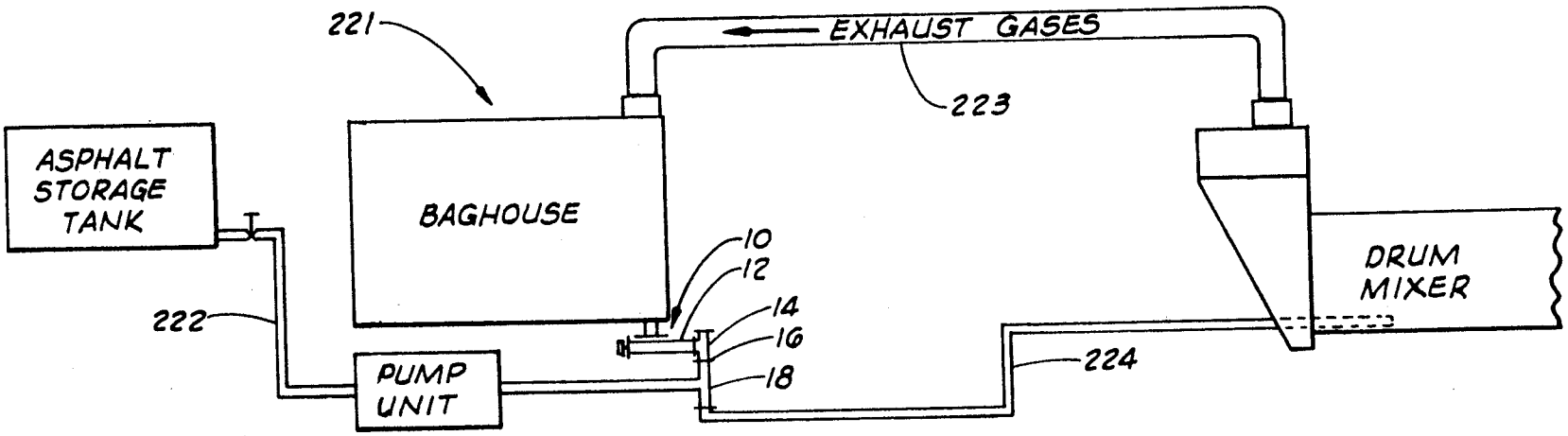
FIG. 7 is a schematic illustration of an asphalt plant illustrating an installed dust return system.

FIG. 7 schematically illustrates the dust return system 10 installed in a conventional asphalt plant 221. In operation, liquid asphalt, urged by a pump unit, is conveyed from the asphalt storage tank through conduit 222 to the mixing chamber 18. Air borne particulate material generated in the drum mixer enters the bag house via conduit 223 and is collected therein. The collected particulate material enters the dust pump 12 and is urged into the receiving housing 14 as described above. The particulate material and the liquid asphalt combine within the mixing chamber 18 to form the slurry stream. The slurry stream exits the mixing chamber 18 and is conveyed, via conduit 224, into the drum mixer for combination with other asphaltic materials therein.

Changes may be made in the combination and arrangement of the parts or elements, as well as in the steps or procedures, without departing from the spirit and scope of the invention as defined in the following claims.

What is claimed is:

1. An apparatus for mixing a particulate additive with liquid asphalt comprising:

means for receiving the particulate additive;

means for mixing the particulate additive with a stream of liquid asphalt wherein the means for mixing comprises, a cylinder having a first end and a second end and a cylinder opening intersecting said ends, and wherein the cylinder is further characterized as having an expanded portion extending from the first end and terminating at an intermediate location on the cylinder and a reduced portion extending from the expanded portion and terminating at the second end of the cylinder;

means for dispensing the particulate additive from the means for receiving to the means for mixing the particulate additive with the liquid asphalt such that the particulate additive is dispensed generally into the center of the stream of liquid asphalt; and wherein the combination of the means for receiving, the means for dispensing and the means for mixing form a closed, pressurized environment.

2. The apparatus of claim 1 wherein the means for mixing comprises:

means for introducing the particulate additive into the cylinder opening to flow towards the second end of the cylinder; and means for introducing liquid asphalt into the cylinder to flow towards the second end of the cylinder.

3. The apparatus of claim 2 wherein the means introducing particulate additive includes a duct having a first end, and a second end and a duct opening intersecting said ends, and wherein the second end of the duct extends into the cylinder opening, and wherein the first end of the duct is secured to the means for dispensing such that particulate additive flows from the first end of the duct to the second end of the duct.

4. The apparatus of claim 3 wherein the second end of the duct is positioned adjacent the transition between the expanded portion and the reduced portion of the cylinder.

5. The apparatus of claim 1 wherein the means for dispensing includes a valve for operation between an open position and a closed position such that when the valve is in the open position, particulate additive flows from the means for receiving into the means for mixing and when the valve is in the closed position, particulate additive is prevented from entering the means for mixing.

6. The apparatus of claim 1 wherein the means for receiving includes a cylinder having a first end, said first end being closed, a second end, said second end being open, and a cavity extending between the first end and the second end, and wherein the means for dispensing is secured to the second end of the means for receiving, and wherein the particulate additive is introduced into the cavity at an intermediate point in the cylinder to flow generally towards the second end thereof.

7. The apparatus of claim 1 further including a thermal jacket substantially surrounding the means for mixing.

8. The apparatus of claim 1 wherein the means for dispensing is disposed between the means for receiving and the means for mixing, and wherein the means for receiving, the means for dispensing and the means for mixing are vertically aligned.

9. The apparatus of claim 1 further comprising means for maintaining the pressure in the means for receiving at a selected pressure differential above the pressure of the liquid asphalt within the means for mixing.

10. The apparatus of claim 1 further comprising means for interrupting the flow of particulate additive from the means for receiving to the means for mixing when the pressure of the liquid asphalt within the means for mixing exceeds a preselected value.

11. The apparatus of claim 1 further comprising:

a drum mixer; and means for conveying the mixture of liquid asphalt and particulate additive to the drum mixer.

12. The apparatus of claim 11 wherein the closed, pressurized environment comprises:

a gas lock formed by a slug of particulate additive; and wherein the means for mixing is between the gas lock and the mixture of liquid asphalt and the particulate additive.

13. An apparatus for mixing a particulate additive with liquid asphalt comprising:

a receiving chamber;

means for mixing the particulate additive with the liquid asphalt wherein the means for mixing comprises a cylinder having a first end and a second end and a cylinder opening intersecting said ends and a duct having a first end, a second end and a duct opening intersecting said ends, wherein the second end of the duct extends into the cylinder opening;

a valve secured between the receiving chamber and the mixing means for operation between an open position and a closed position such that when the valve is in the closed position, particulate additive is prevented from entering the means for mixing;

wherein the combination of the receiving chamber, the valve and the means for mixing form a closed, pressurized environment; and means for monitoring the pressure within the closed pressurized environment.

14. An apparatus for mixing a particulate additive with liquid asphalt comprising:

a receiving chamber wherein the receiving chamber includes a cylinder having a first end, said first end being closed, a second end, said second end being open, and a cavity extending between the first end and the second end, and wherein the valve is secured to the second end of the receiving chamber, and wherein the particulate additive is introduced into the cavity at an intermediate point in the cylinder to flow generally towards the second end thereof;

means for mixing the particulate additive with the liquid asphalt;

a valve secured between the receiving chamber and the mixing means for operation between an open position and a closed position such that when the valve is in the closed position, particulate additive is prevented from entering the means for mixing;

wherein the combination of the receiving chamber, the valve and the means for mixing form a closed, pressurized environment; and means for monitoring the pressure within the closed pressurized environment.

* * * * *